United States Patent [19]

Unuma

[11] Patent Number: 4,867,591

[45] Date of Patent: Sep. 19, 1989

[54] PAPER FEEDING ENDLESS BELT FOR PRINTER

[75] Inventor: Sadao Unuma, Aichi, Japan

[73] Assignee: Toyai Kogyo Kabushiki Kaisha, Aichi, Japan

[21] Appl. No.: 123,971

[22] Filed: Nov. 17, 1987

[30] Foreign Application Priority Data

Dec. 5, 1986 [JP] Japan ..... 61-188159[U]

[51] Int. Cl.[4] ..... B41J 11/30

[52] U.S. Cl. ..... 400/616.1; 226/74

[58] Field of Search ..... 400/616, 616.1, 616.2, 400/616.3; 226/74, 87

[56] References Cited

U.S. PATENT DOCUMENTS

| | | | |
|---|---|---|---|
| 1,380,532 | 6/1921 | Cunningham | 226/87 |
| 2,806,691 | 9/1957 | Kalin | 226/87 |
| 3,744,820 | 7/1973 | Porter | 400/616.1 X |
| 3,949,856 | 4/1976 | Ulber et al. | 400/616.3 X |
| 4,005,810 | 2/1977 | Porter | 400/616.3 X |
| 4,473,179 | 9/1984 | Bauer | 226/87 X |
| 4,614,287 | 9/1986 | Ueno et al. | 400/616.1 X |
| 4,741,641 | 5/1988 | Kuzuya et al. | 400/616.2 |

FOREIGN PATENT DOCUMENTS 58-192045 12/1983 Japan ..... 400/616.1

OTHER PUBLICATIONS

IBM Technical Disclosure Bulletin, "Dynamic Paper Feed Hole Tester", Engel et al, vol. 24, No. 3, Aug. 1981, pp. 1711–1712.

*Primary Examiner*—Ernest T. Wright, Jr.

*Attorney, Agent, or Firm*—Berman, Aisenberg & Platt

[57] ABSTRACT

An endless belt used in a paper feeding apparatus for feeding paper to a printer in a computer or the like, the paper having feed holes formed at equal intervals in both side portions thereof. A large number of feed pins to be inserted into the above feed holes are formed on the outer peripheral surface of the endless belt. The feed pins are arranged so that there is repeated a pattern of interaxial spacings of P+a/2, P+a/2, P−a/2 and P−a/2, in which P is the distance between the centers of feed holes formed in the paper and a is a mean value of differences between feed pin outside diameters of the portions in abutment with edge portions of the feed holes and the feed hole diameter. Alternatively, the feed pins may be arranged at interaxial spacing between adjacent feed pins of P+a and P−a alternately.

2 Claims, 3 Drawing Sheets

PAPER FEEDING ENDLESS BELT FOR PRINTER

BACKGROUND OF THE INVENTION

1. Field of the Invention

The present invention relates to an endless belt for feeding paper to a printer in an apparatus for feeding paper to printers used in computers, word processors, plotters, etc. as well as various other printers.

2. Description of the Prior Art

As paper for recording characters and graphics which are printed from printers used in computers, word processors, plotters, etc., there is used in many cases paper having a single row of feed holes formed in each of both side portions of the paper. The feed holes are formed at equal intervals on straight lines extending along both side edges of the paper in positions spaced a predetermined distance from the side edges.

In an apparatus for feeding this kind of paper to a printer, a pair of endless belts are disposed along the feed path of paper to be fed to the printer, in positions corresponding to both side portions of the paper. On each of the endless belts are formed a large number of feed pins in a single row at the same intervals as those of the feed holes formed in the paper. The endless belt is interconnected between a driving pulley and a driven pulley or a belt guide member. When the driving pulley is rotated, a plurality of feed pins located on the rectilinear portion of the endless belt between the driving pulley and the driven pulley or the belt guide member come into engagement with feed holes formed in the paper, thereby feeding the paper to the printer.

Generally speaking, in order to facilitate the insertion of the feed pins formed on the endless belt into the feed holes formed in paper, the outer peripheral surface of each feed pin is in the form of a truncated cone having a conical peripheral surface formed as a curved surface somewhat expanding outwards. Further, in order for the engaged pins to be easily disengaged from the feed holes, the outside diameter of the portion of each feed pin which portion comes into engagement with a feed hole is set a little smaller than the diameter of the feed hole.

During printing of characters or graphics on paper in a printer, the endless belts sometimes repeat their forward and backward movements to move the paper forward and backward repeatedly. For moving the paper forward, as shown in FIG. 5, the outer peripheral portions on the front side in the feed direction of feed pins 7 provided on a rectilinear portion 4 of an endless belt 1 come into abutment with the edge portions on the front side in the feed direction of feed holes 13 formed in paper 12, whereby the paper 12 is moved forward. On the other hand, for moving the paper backward, as shown in FIG. 6, the outer peripheral portion on the rear side with respect to the feed direction of the feed pins 7 come into abutment with the edge portions on the rear side with respect to the feed direction of the feed holes 13 formed in the paper 12, whereby the paper is moved backward. In such a structure, when forward and backward movements of the endless belt 1 are repeated, the amount of forward feed and that of backward feed of the paper 12 are sometimes not coincident with those of the endless belt 1 due to gaps formed between the outer peripheral surfaces of the feed pins 7 and the peripheral edges of the feed holes 13, resulting in that characters or graphics to be printed are not printed accurately.

SUMMARY OF THE INVENTION

It is a primary object of the present invention to provide an endless belt which converts the amount of its movement accurately into the amount of movement of paper to be fed to a printer by the endless belt.

It is another object of the present invention to provide an endless belt which, even when forward and backward movements are transmitted alternately to the endless belt, paper to be fed to a printer by the belt is moved forward and backward alternately by the same distance as the amount of movement of the belt.

According to the present invention, in order to attain the above-mentioned objects, there is provided an endless belt having feed pins formed at approximately equal intervals on the outer peripheral surface thereof which is to be interconnected between a driving pulley and a driven pulley or a belt guide member and with a group of said feed pins present on a rectilinear portion extending between the driving pulley and the driven pulley or the belt guide member being fitted into feed holes formed in paper; in which said group of the feed pins are arranged at intervals determined so that at least one of the said group of feed pins is in abutment at its outer peripheral surface portion on the front side with respect to the paper feed direction with the edge portion on the front side with respect to the paper feed direction of the corresponding feed hole formed in the paper and at least one other pin is in abutment at its outer peripheral surface portion on the rear side with respect to the paper feed direction with the edge portion on the rear side with respect to the paper feed direction of the corresponding feed hole formed in the paper.

It is here assumed that the distance between the centers of feed holes formed in the paper is P and a mean value of differences between feed pin outside diameters of the portions in abutment with edge portions of the feed holes and the feed hole diameter is a. Then in a preferred embodiment of the present invention, a mean value of spacings between feed pins obtained by dividing the distance joining the central axes of the feed pins positioned at both ends of a group of n number of feed pins by $n-1$ is equal to the spacing P which is the distance between the centers of adjacent feed holes formed in the paper; the spacing between the central axis of the feed pin positioned at one end of the said group and that of the adjacent feed pin is $P+a/2$; and the spacing between the central axis of the feed pin positioned at the opposite end of the group and that of the feed pin adjacent thereto is $P-a/2$. In another preferred embodiment of the present invention, the spacing between the central axis of any one feed pin and that of the pin which is adjacent thereto on one side with respect to the paper feed direction is $P+a$ and the spacing between the central axis of the said one feed pin and that of the pin which is adjacent thereto on the opposite side with respect to the paper feed direction is $P-a$.

According to the present invention, at least one of the feed pins which are present on a rectilinear portion of the endless belt interconnecting the driving pulley and the driven pulley or the belt guide member of a paper feeding apparatus and which are inserted in the feed holes of paper being fed, is in abutment at its outer peripheral surface portion on the front side in the paper feed direction with the edge portion on the front side in the said feed direction of the corresponding feed hole formed in the paper and at least one other pin is in abutment at its outer peripheral surface portion on the rear side with respect to the paper feed direction with the edge portion on the rear side with respect to the said feed direction of the corresponding feed hole formed in the paper. Therefore, even when the paper feeding apparatus repeats the paper advancing and retreating operations, the amounts of forward and backward movements of the endless belt are converted accurately into amounts of forward and backward movements of the paper every time such operations are performed.

BRIEF DESCRIPTION OF THE DRAWINGS

For a fuller understanding of the present invention, reference is had to the following description taken in connection with the accompanying drawings, in which.

DETAILED DESCRIPTION OF THE PREFERRED EMBODIMENTS

Figure 1:
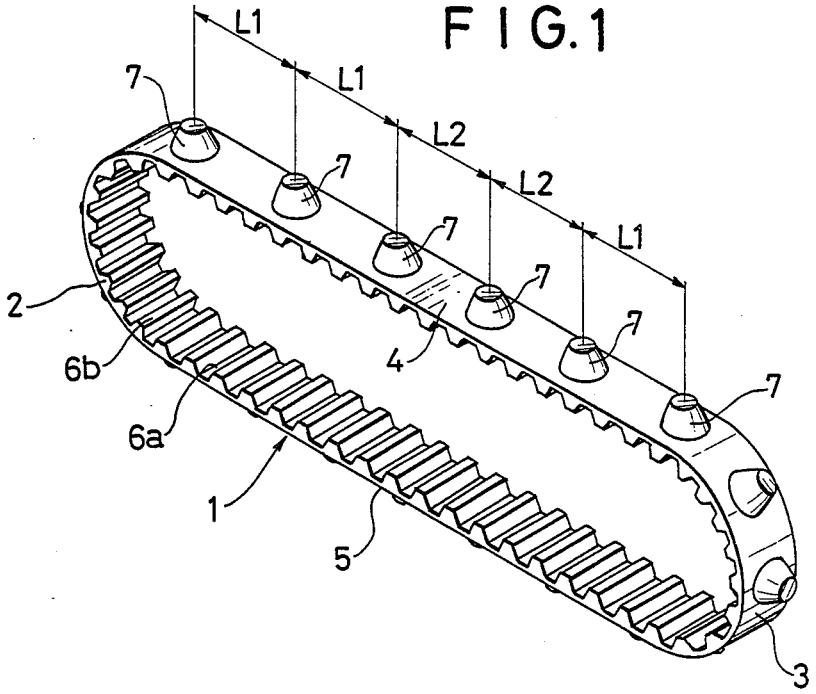
FIG. 1 is a perspective view of an endless belt according to a preferred embodiment of the present invention.

With reference to the Figures, and initially to FIG. 1, an endless belt 1 is formed endlessly from a flexible synthetic resin and it is provided along its inner peripheral surface with grooves 6a which are in close engagement with teeth 9a formed on a laterdescribed driving pulley 9, as well as tooth-like projections 6*b* each formed between adjacent grooves 6a. Thus the grooves 6*a* and the tooth-like projections 6b are formed alternately. On the outer peripheral surface of the endless belt 1 are projectingly provided a large number of feed pins 7 at approximately equal intervals in a single row in the longitudinal direction of the belt 1. The feed pins 7 are each formed in the shape of a truncated cone having an axis perpendicular to the outer surface of the endless belt 1. In order to facilitate the insertion of the feed pins 7 into feed holes 13 formed in paper 12, the conical outer peripheral surface of each feed pin 7 is in the form of an outwardly expanding curved surface. Further, to facilitate disengagement of the feed pins 7 from the feed holes 13 formed in paper 12, the outside diameter of the portion of each feed pin 7 which portion intersects the outer peripheral surface of the endless belt 1 is made either equal to or a little smaller than the diameter of each such feed hole 13 formed in the paper 12, and at least the outside diameter of the outer peripheral surface of a portion of the feed pin 7 which is in abutment with the edge portion of the feed hole 13 is made smaller than the feed hole diameter.

Figure 2:
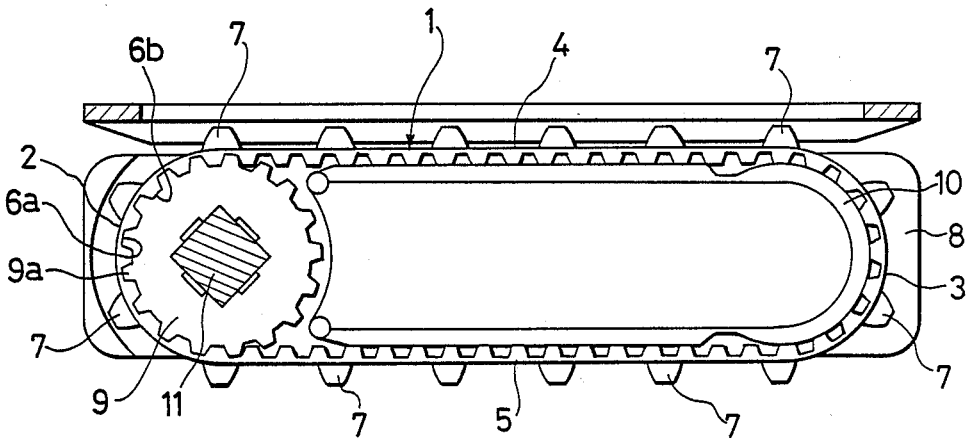
FIG. 2 is a side view of a paper feeding apparatus in a conventional printer for a computer in which the above belt is interconnected between a driving pulley and a belt guide member.

The endless belt 1, as shown in FIG. 2, is interconnected between the driving pulley 9 and a belt guide member 10 which are supported between a pair of frames 8 of an apparatus for feeding paper 12 to a printer (not shown) in a computer, a word processor, or a plotter (not shown). The belt 1 is engaged without slipping with the teeth 9*a* formed on the outer peripheral surface of the driving pulley 9 through its grooves 6a and tooth-like projections 6*b* formed in the inner peripheral surface thereof. In interconnecting the driving pulley 9 and the guide member 10, the endless belt 1 forms an arcuate portion 2 which is in engagement with the outer peripheral surface of the driving pulley 9 and an arcuate portion 3 which is in sliding contact with an arcuate guide surface of the belt guide member 10, as well as rectilinear portions 4 and 5 located between the arcuate portions 2 and 3. When the driving pulley 9 is rotated by a driving shaft 11 connected to a drive source (not shown), the feed pins 7 formed on the outer peripheral surface of the rectilinear portion 4 which occupies an upper position in FIG. 2 come into abutment with edge portions of feed holes 13 formed in paper 12, whereby the paper 12 is moved in the moving direction of the rectilinear portion 4 of the endless belt 1.

In the above apparatus for feeding paper 12 to a printer, as well known, a pair of endless belts 1 are disposed in positions corresponding to both side portions of paper 12 to be fed and driving pulleys 9 engaged with the endless belts 1 are driven synchronizedly by means of the driving shaft 11, allowing feed pins 7 of the endless belts 1 to come into engagement at the respective side edge portions with feed holes 13 which are formed in a single row in each of both side portions of the paper 12, to thereby feed the paper 12 to the printer. FIG. 2 shows a driving unit located on one side of such apparatus.

Figure 3:
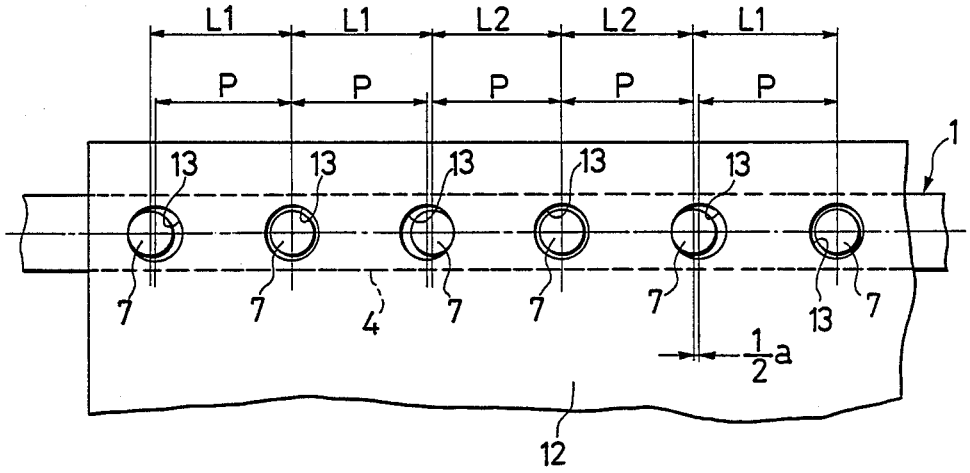
FIG. 3 is a top view of a part of the endless belt which is functioning to move paper in the above embodiment.

In connection with the spacing between the axes of adjacent feed pins 7 in a preferred embodiment of the endless belt 1 according to the present invention, a mean value of interpin spacings of n number of feed pins 7 (n=5 in FIGS. 1 and 3) is made equal to the spacing P between the centers of adjacent feed holes 13 formed in the paper 12 to be fed, provided two kinds of spacings are set as spacings between the axes of adjacent feed pins 7, one being $L_1$ larger than the spacing P and the other $L_2$ smaller than the spacing P. Further, the difference a between those sizes $L_1$ and $L_2$ is made equal to a mean value of differences between diameters of the feed holes 13 of the paper 12 and outside diameters of the outer peripheral portions of the feed pins 7 which are in abutment with the feed holes 13, and the lengths $L_1$ and $L_2$ are determined to be $P+a/2$ and $P-a/2$. By doing so, when the left-hand outer peripheral surface of the leftmost feed pin 7 out of the feed pins 7 shown in FIGS. 1 and 3 abuts the lefthand edge portion of the corresponding feed hole 13 formed in the paper 12, the fifth feed pin 7 from the leftmost end abuts the edge portion of the corresponding feed hole 13 in the same state as the leftmost feed pin 7; the third feed pin 7 from the leftmost end is in abutment at its right-hand outer peripheral surface with the right-hand edge portion of the corresponding feed hole 13; and the axes of the second and fourth feed pins 7 from the leftmost end are coincident with the centers of the corresponding feed holes 13 without abutment at their outer peripheral surfaces with the edges of the feed holes 13. When the five feed pins 7 arranged at such intervals are in their positions corresponding to the rectilinear portion 4 of the endless belt 1, at least the first and third feed pins 7 from the leftmost end are in abutment with the front and rear edges respectively of the corresponding feed holes 13 of the paper 12 with respect to the paper feed direction, so even when the moving direction of the endless belt 1 changes direction from one, for example, the direction from right to left in FIG. 3, to the opposite direction, that is, the direction from left to right in the same figure, the paper 12 is moved in both such directions by the distances corresponding to the amounts of movement of the endless belt 1 by means of the above two feed pins 7. The same as above can also be said of the third and fifth feed pins 7 out of the foregoing five feed pins 7.

Thus, in connection with the interaxial spacing of the feed pins 7 arranged in the longitudinal direction of the endless belt 1, if the feed pins 7 are arranged regularly so that the spacing $P+a/2$ continues twice and then the spacing $P-a/2$ continues twice, every second one out of the feed pins 7 come into abutment successively with the front and then the rear edge portion of the corresponding feed holes 13 formed in the paper 12. In this way, no matter in which direction the paper 12 is fed, the amount of movement of the paper 12 and that of the endless belt 1 can be made equal to each other accurately and hence characters and graphics can be printed accurately by the printer.

Figure 4:
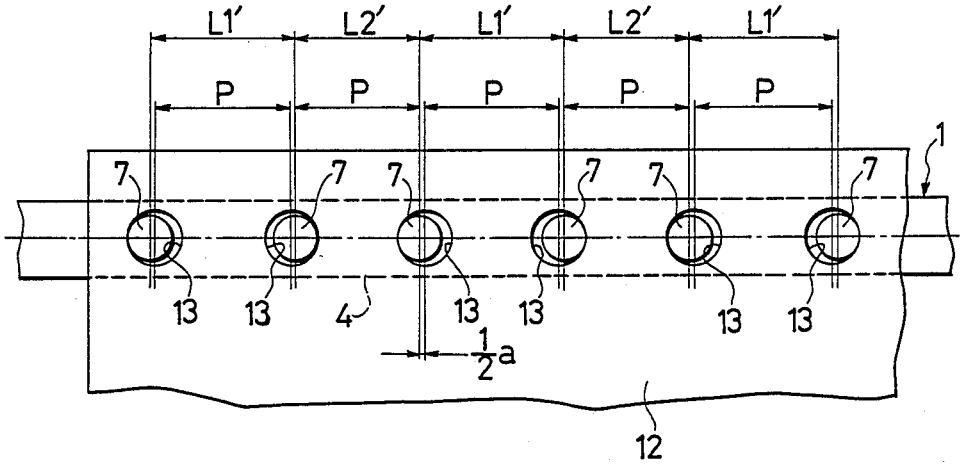
FIG. 4 is a top view of a part of an endless belt which is functioning to move paper in another preferred embodiment of the present invention.
Figure 5:
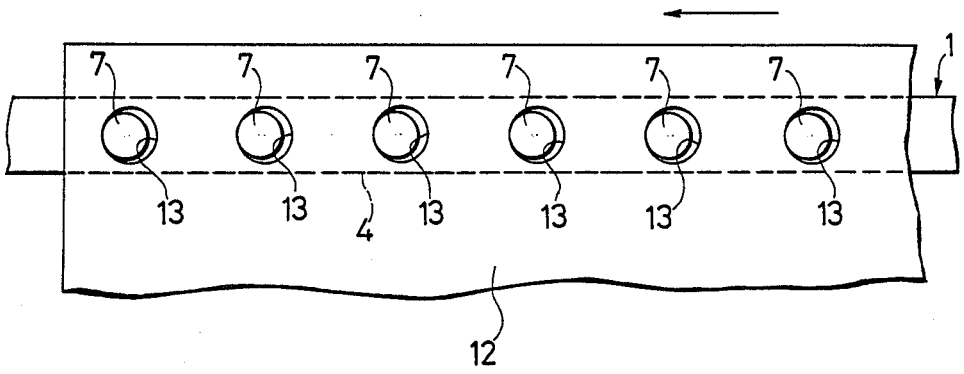
FIG. 5 PRIOR ART
FIGS. 5 and 6 are top views of a part of a conventional endless belt which is functioning to move paper, respectively.
Figure 6:
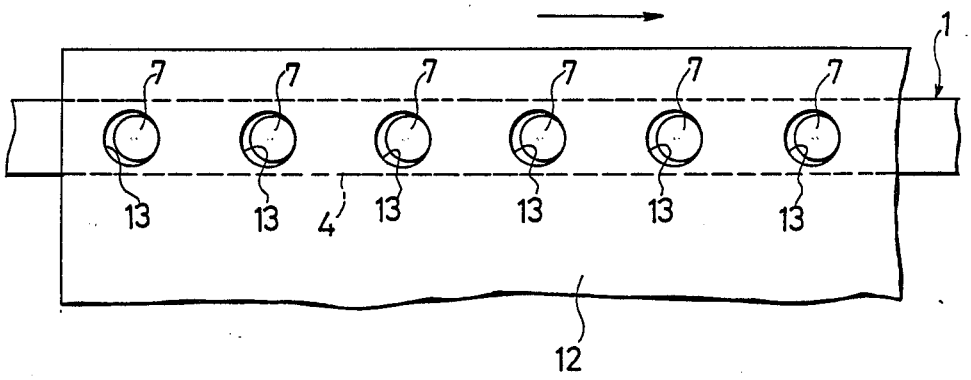
FIG. 6 PRIOR ART

FIG. 4 shows an arrangement of feed pins 7 according to another preferred embodiment of the present invention. In this embodiment, two kinds of spacing $L_1'=P+a$ and $L_2'=P-a$ are set as spacings between the axes of adjacent feed pins 7 which are arranged in the longitudinal direction of the endless belt 1. The feed pins 7 are arranged so that the spacings $L_1'$ and $L_2'$ are repeated alternately. Under such arrangement of the feed pins 7, the leftmost feed pin 7 in FIG. 4 comes into abutment at its left-hand outer peripheral surface portion with the left-hand edge of the corresponding feed hole 13 formed in the paper 12, and the second feed pin 7 from the leftmost end comes into abutment at its right-hand outer peripheral surface portion with the right-hand edge portion of the corresponding feed hole 13 formed in the paper 12, so that these two feed pins 7 transmit in pairs the amount of movement of the endless belt 1 to the paper 12 accurately. Likewise, the second and third feed pins 7 from the leftmost end transmit in pairs the amount of movement of the endless belt 1 to the paper 12 accurately. Thus, in this embodiment, two adjacent feed pins 7 in pairs come into abutment with front and rear edge portions respectively of the corresponding feed holes 13 with respect to the paper feed direction, so characters and graphics can be printed accurately even when the moving direction of the endless belt 1 is reversed during printing operation of the printer. This embodiment is applicable effectively to a paper feeding apparatus for a printer in which the rectilinear portion 4 of the endless belt 1 cannot be made large.

What is claimed is:

1. A feeding belt for use in a paper feeding apparatus for feeding paper having a single row of feed holes formed in each of both side portions of said paper at equal intervals on a straight line extending along each side edge of said paper, said feeding belt comprising:

an endless belt formed from a flexible material, and a number of feed pins projectingly provided at approximately equal intervals on an outer peripheral surface of said endless belt in a single row in the longitudinal direction thereof to be inserted in said feed holes of said paper with a group of said feed pins present consecutively on a rectilinear portion of said endless belt when said endless belt is stretched in said paper feeding apparatus for feeding said paper by engaging an outer peripheral surface of at least one feed pin with in said group of feed pins in abutment with an edge portion of a corresponding feed hole formed in said paper, each of said feed pins having an axis perpendicular to said outer peripheral surface of said endless belt and said feed pins being so arranged that a spacing between axes of adjacent feed pins of $P+a/2$ is repeated twice and then a spacing of $P-a/2$ is repeated twice, wherein P is the distance between the centers of said feed holes formed in said paper and a is the difference between a diameter of said feed holes formed in said paper and an outer diameter of said peripheral surface of said feed pins in abutment with an edge portion of said feed holes, whereby at least one pin in said group of feed pins is in abutment at its outer peripheral surface portion, on the front side thereof with respect to a paper feed direction, with said edge portion of said corresponding feed hole formed in said paper, on the front side thereof with respect to said paper feed direction, and at least one other pin in said group of feed pins is in abutment at its outer peripheral surface portion, on the rear side thereof with respect to said paper feed direction, with an edge portion on the rear side of a corresponding feed hole formed in said paper with respect to said feed direction.

2. A feeding belt for use in paper feeding apparatus for feeding paper having a single row of feed holes formed in each of both side portions of said paper at equal intervals on a straight line extending along each side edge of said paper comprising:

an endless belt formed from a flexible material, and a number of feed pins projectingly provided at approximately equal intervals on an outer peripheral surface of said endless belt in a single row in the longitudinal direction thereof to be inserted in said feed holes of said paper with a group of said feed pins present consecutively on a rectilinear portion of said endless belt when said endless belt is stretched in said paper feeding apparatus for feeding said paper by engaging an outer peripheral surface of at least one feed pin within said group of feed pins in abutment with an edge portion of a corresponding feed hole formed in said paper, each of said feed pins having an axis perpendicular to said outer peripheral surface of said endless belt and said feed pins being so arranged that a spacing between axes of adjacent feed pins $P+a$ and $P-a$ is repeated alternately, wherein P is the distance between the centers of said feed holes formed in said paper and a is the difference between a diameter of said feed holes formed in said paper and an outer diameter of said peripheral surface of said feed pins in abutment with an edge portion of said feed holes, whereby at least one pin in said group of said feed pins is in abutment at its outer peripheral surface portion, on the front side thereof with respect to a paper feed direction, with said edge portion of said corresponding feed hole formed in said paper on the front side thereof with respect to said paper feed direction and at least one other pin in said group of feed pins is in abutment at its outer peripheral surface portion, on the rear side thereof with respect to said paper feed direction, with an edge portion on the rear side of a corresponding feed hole formed in said paper with respect to said paper feed direction.

* * * * *